United States Patent [19]

Stockton

[11] Patent Number: 4,810,223

[45] Date of Patent: Mar. 7, 1989

[54] HOT AIR BALLOON TOY

[76] Inventor: Ben J. Stockton, 2712 Canterbury Ave., Ponca City, Okla. 74604

[21] Appl. No.: 41,689

[22] Filed: Apr. 23, 1987

[51] Int. Cl.[4] ..... A63H 33/26; A63H 27/10

[52] U.S. Cl. ..... 446/129; 446/225

[58] Field of Search ..... 446/225, 220, 223, 129, 446/137; 244/31

[56] References Cited

U.S. PATENT DOCUMENTS

| | | | |
|---|---|---|---|
| 344,515 | 6/1886 | Biehl | 446/225 |
| 673,776 | 5/1901 | Kavanagh | 446/223 |
| 916,605 | 3/1909 | Rouse | 446/225 |
| 1,755,161 | 4/1930 | Weimer | 446/223 |
| 2,702,191 | 2/1955 | Lemelson | 446/129 X |
| 2,960,282 | 11/1960 | Winzen | 244/31 |

*Primary Examiner*—Mickey Yu

*Attorney, Agent, or Firm*—Leon Gilden

[57] ABSTRACT

A toy hot air balloon effectively utilizes a cover positionable over an inflated toy balloon. The toy includes a suspended gondola, and the interiorly positioned toy balloon is substantially hidden from view within the balloon cover. An optional lightweight circular plate positioned on a topmost portion of the cover allows the toy to float against a ceiling structure. When a lighter-than-air gas is not used to inflate the toy balloon, the top circular plate may be constructed from a material which permits the balloon to be attached to ceiling structures, such as over-head lamps, drop ceiling supports, etc.

6 Claims, 2 Drawing Sheets

HOT AIR BALLOON TOY

BACKGROUND OF THE INVENTION

1. Field of the Invention

The present invention relates to aerial toys, and more particularly pertains to a new and improved toy balloon cover which simulates a hot-air balloon.

2. Description of the Prior Art

The use of toy balloons to simulate lighter-than-air devices is known in the prior art. For example, reference is made to U.S. Pat. No. 4,145,838, which issued to C. Mason on Mar. 27, 1979. The Mason toy consists of a basket gondola made of a light plastic or some other material which is then attached to the bottom of a toy balloon. The balloon is filled with a gas less heavy than air, such as helium, so as to provide the buoyancy required to lift the gondola into the air. The basket gondola and balloon are held together by means of stretching the balloon knot though a keyhole slot made in the basket gondola. The knot is held in place by wedging it into a thin part of the keyhole slot. The basket gondola and balloon construction is utilized as a child's toy or for advertising promotion.

While the Mason balloon toy is functional for its intended purpose, it can be appreciated that its appearance is not particularly similar to a conventional full sized hot air balloon. More particularly, the balloon knot and the transparent construction of the balloon make it evident that the device is not designed to be a substantial replica of a real hot air balloon capable of carrying several adults. Further, when the Mason device is filled with a lighter-than-air gas whereby it can float in the air, the device is subject to rapid destruction when the exposed outer surface of the balloon comes into contact with pointed or sharp objects. Additionally, no means are provided for retaining the balloon toy in a particular desired location, and accordingly, the danger of the toy being destroyed is substantially increased by this inability to retain it within preselected areas. As such, it can be appreciated that there is a continuing need for new and improved floating balloon toys whereby the supporting balloon is more carefully protected from destruction and also where the toy can be positioned in a preselected desired location. In this respect, the invention substantially fulfills this need.

SUMMARY OF THE INVENTION

In view of the foregoing disadvantages inherent in the known types of aerial balloon toys now present in the prior art, the present invention provides an improved aerial balloon toy wherein the supporting balloon is concealed and protected by an overlying cover, while attachment and positioning means are attached a topmost portion of the cover. As such, the general purpose of the present invention, which will be described subsequently in greater detail, is to provide a new and improved aerial balloon toy which has all the advantages of the prior art aerial balloon toys and none of the disadvantages.

To attain this, the present invention comprises a cover designed to completely encapsulate an inflated balloon. The balloon is positioned within the cover and is then inflated so as to give the appearance of an conventional full sized hot air balloon. The toy balloon knot is hidden from view within the cover, and the balloon may be filled with any type of inflating gas, such as air, helium, or the like. The cover is further provided with a suspended gondola and also with a topmost positioned circular plate. The plate provides a flat surface on a top portion of the cover so as to allow the balloon to rest in a stable manner against a ceiling. When the balloon is inflated with a gas which is not lighter than air, whereby no buoyant support is provided by the gas, the top plate may be constructed of a thin magnet so as to allow the toy to be magnetically attached to various metallic objects located in a conventional ceiling.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved aerial balloon toy which has all the advantages of the prior art aerial balloon toys and none of the disadvantages.

It is another object of the present invention to provide a new and improved aerial balloon toy which may be easily and efficiently manufactured and marketed.

It is a further object of the present invention to provide a new and improved aerial balloon toy which is of a durable and reliable construction.

An even further object of the present invention is to provide a new and improved aerial balloon toy which is susceptible of a low cost of manufacture with regard to both materials and labor, and which accordingly is then susceptible of low prices of sale to the consuming public, thereby making such aerial balloon toys economically available to the buying public.

Still yet another object of the present invention is to provide a new and improved aerial balloon toy which provides in the apparatuses and methods of the prior art some of the advantages thereof, while simultaneously overcoming some of the disadvantages normally associated therewith.

Still another object of the present invention is to provide a new and improved aerial balloon toy which substantially resembles a full sized conventional hot air balloon.

Yet another object of the present invention is to provide a new and improved aerial balloon toy which allows for the attachment thereof to various objects.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
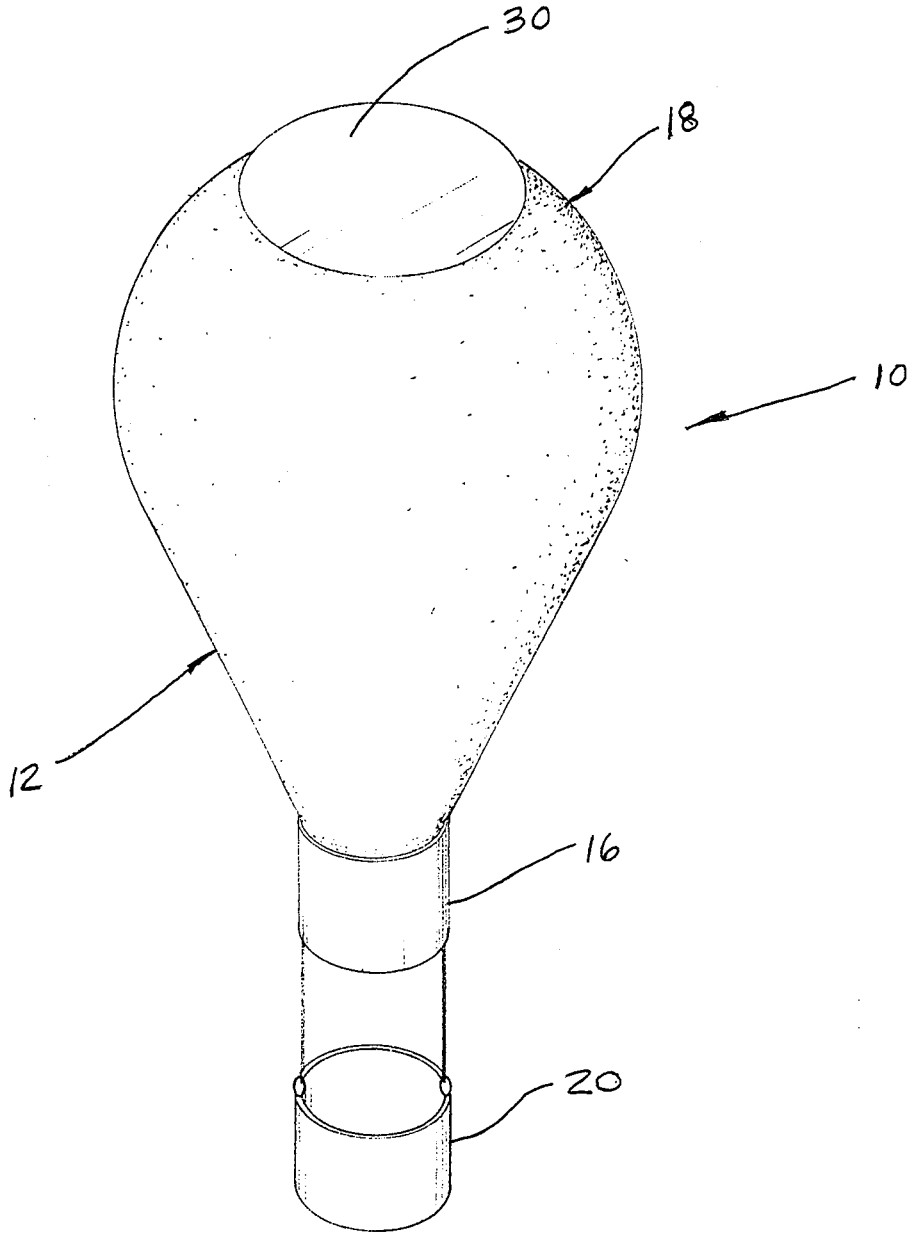
FIG. 1 is a perspective view of the hot air balloon toy comprising the present invention.
Figure 2:
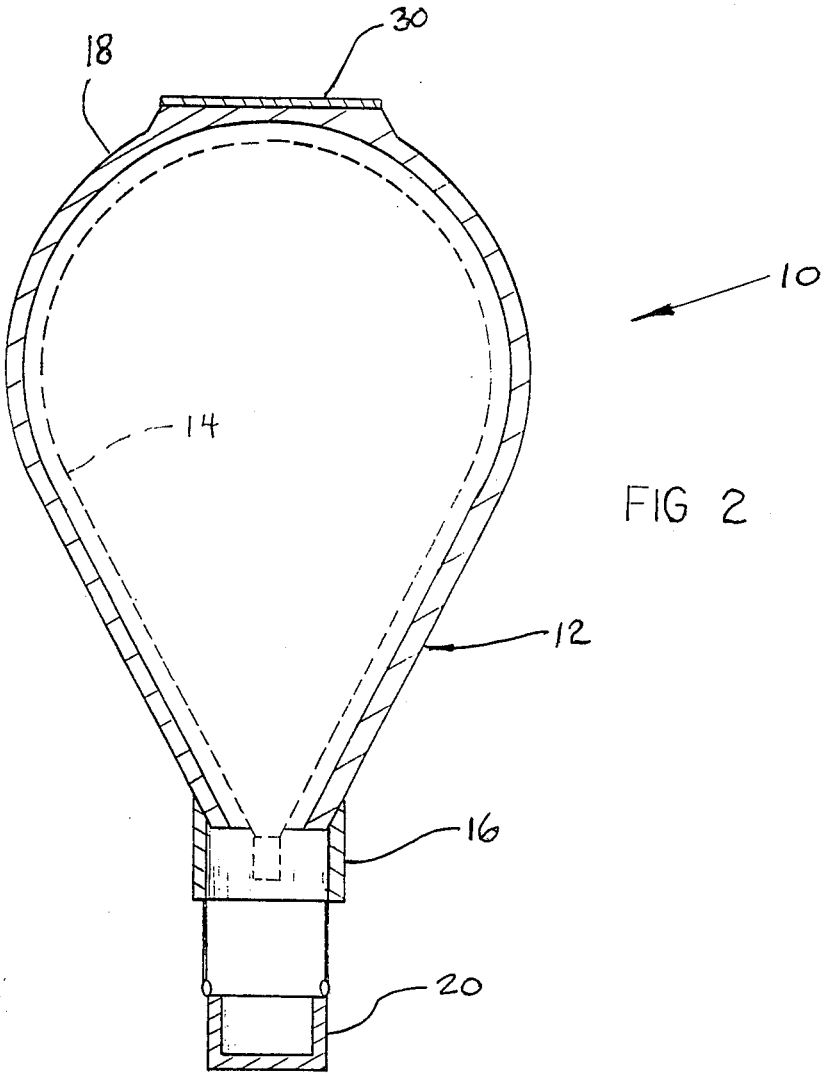
FIG. 2 is a cross-sectional side elevational view thereof.
Figure 3:
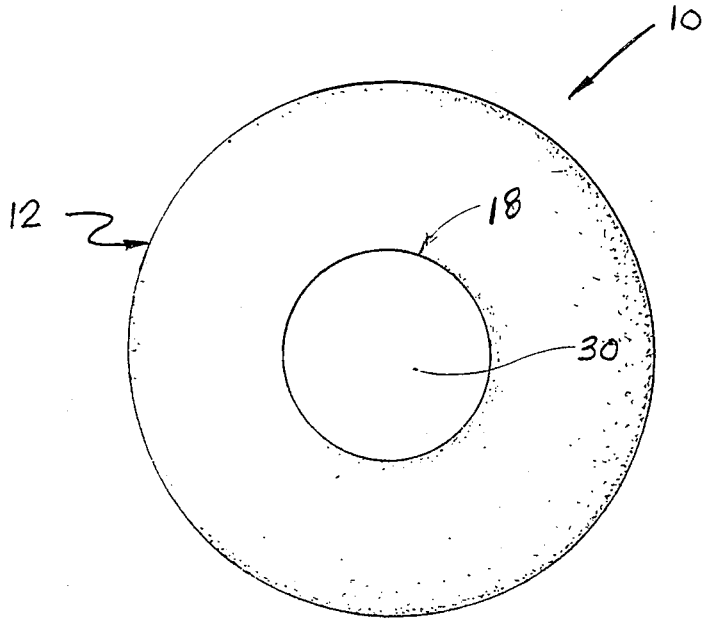
FIG. 3 is a top plan view of the invention.

With reference now to the drawings, and in particular to FIGS. 1, 2 and 3 thereof, a new and improved aerial balloon toy embodying the principles and concepts of the present invention and generally designated by the reference numeral 10 will be described.

More specifically, it will be noted that the aerial balloon toy 10 essentially comprises a flexible cover assembly 12, which includes a flexible cover 18 and circular skirt 16, positionable over and encapsulating a conventional toy balloon 14. The cover assembly 12 may be formed from fabric, lace, paper, vinyl, or any other material which would provide the necessary flexibility. Additionally, various colors and designs are within the intent and purview of the present invention, and all such materials, colors and designs are intended to be encompassed by the claims appended hereto.

Typically, the cover 12 would be formed around the circular top portion 18 and the circular skirt portion 16 is fixedly attached thereto by some conventional means, such as by sewing, gluing, or the like. The cover portions 12, 16, 18 are combined to provide the appearance of a conventional full sized hot air balloon.

Additionally, a flat circular plate 30 may optionally be attached to the top portion of the cover 18 with this plate typically being formed from a rigid material. Attached to a bottom edge of the skirt portion 16 is a toy gondola structure 20 which completes the appearance of a conventional full sized hot air balloon.

With respect to the manner of usage and operation of the aerial balloon toy 10, it can be appreciated that a conventional toy balloon 14 may be inserted within the interior portion of the aerial balloon toy 10, and is then inflated with a gas, such as air, helium, etc. If a lighter than air gas is utilized, the toy may float upwardly into contact with an overhead structure, such as a ceiling. The flat plate 30 will provide stability to the toy so that it remains substantially in position at its point of contact. When a heavier-than-air gas is utilized to inflate the aerial toy balloon 10, the plate 30 may be constructed from a thin sheet of magnetic material so as to allow the toy to be magnetically attached and suspended from some overhead ferromagnetic structure, such as a lamp, suspended ceiling support, or the like.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A new and improved aerial balloon toy comprising:

an inflatable toy balloon, a balloon cover means positionable over said inflatable toy balloon; and substantially flat plate means attached to a topmost portion of said balloon cover means, said flat plate means permitting a stabilizing contact between said balloon toy and an overhead structure, and further including a toy gondola means suspended from a bottommost portion of said balloon cover means, and wherein said balloon cover means substantially covers and conceals said inflatable toy balloon, and wherein said flat plate means is formed from a rigid material, and wherein said rigid material comprises plastic, and wherein said rigid material comprises a thin sheet of magnetic material, whereby said flat plate means may be magnetically attached to and suspended from a ferromagnetic material.

2. The new and improved aerial balloon toy as described in claim 1, wherein said inflatable toy balloon is positioned within said balloon cover means prior to inflation.

3. A new and improved aerial balloon toy comprising:

an inflatable toy balloon, balloon cover means positionable over said inflatable toy balloon; and substantially flat plate means attached to a topmost portion of said balloon cover means, said flat plate means permitting a stabilizing contact between said balloon toy and an overhead structure, and further including toy gondola means suspended from a bottommost portion of said balloon cover means, and wherein said balloon cover means substantially covers and conceals said inflatable toy balloon.

4. The new and improved aerial balloon toy as described in claim 3, wherein said flat plate means is formed from a rigid material.

5. The new and improved aerial balloon toy as described in claim 4, wherein said rigid material comprises plastic.

6. The new and improved aerial balloon toy as described in claim 4, wherein said rigid material comprises a thin sheet of magnetic material, whereby said flat plate means may be magnetically attached to and suspended from a ferromagnetic material.

* * * * *